US009364849B2

(12) United States Patent
Uehara

(10) Patent No.: US 9,364,849 B2
(45) Date of Patent: Jun. 14, 2016

(54) APPLICATOR

(75) Inventor: Junya Uehara, Fujioka (JP)

(73) Assignee: MITSUBISHI PENCIL COMPANY, LIMITED, Tokyo (JP)

( * ) Notice: Subject to any disclaimer, the term of this patent is extended or adjusted under 35 U.S.C. 154(b) by 264 days.

(21) Appl. No.: 14/009,932

(22) PCT Filed: Apr. 25, 2012

(86) PCT No.: PCT/JP2012/061116

§ 371 (c)(1),
(2), (4) Date: Oct. 4, 2013

(87) PCT Pub. No.: WO2012/147806

PCT Pub. Date: Nov. 1, 2012

(65) Prior Publication Data

US 2014/0016987 A1 Jan. 16, 2014

(30) Foreign Application Priority Data

Apr. 28, 2011 (JP) ..... 2011-101914
Apr. 9, 2012 (JP) ..... 2012-088404

(51) Int. Cl.
*B05C 17/00* (2006.01)
*A45D 34/04* (2006.01)
(Continued)

(52) U.S. Cl.
CPC ..... *B05C 17/00* (2013.01); *A45D 34/04* (2013.01); *B43K 8/02* (2013.01); *B43K 8/03* (2013.01); *B43K 8/04* (2013.01); *B43K 23/128* (2013.01); *A45D 2200/1072* (2013.01)

(58) Field of Classification Search
CPC ..... A45D 34/04; A45D 34/042; A45D 40/26; A45D 40/262
USPC ..... 401/261, 265, 268, 270, 282, 286, 287, 401/291
See application file for complete search history.

(56) References Cited

U.S. PATENT DOCUMENTS 4,527,575 A * 7/1985 Vasas ..... 401/129
5,247,951 A 9/1993 Machida et al.
(Continued)

FOREIGN PATENT DOCUMENTS

FR 2 912 882 A1 6/2008
JP 5-91510 U 12/1993
(Continued)

OTHER PUBLICATIONS

Extended European Search Report issued on Oct. 30, 2014, by the European Patent Office in corresponding European Patent Application No. 12777583.1-1653 (3 pages).
(Continued)

*Primary Examiner* — Jennifer C Chiang
*Assistant Examiner* — Bradley Oliver
(74) *Attorney, Agent, or Firm* — Buchanan, Ingersoll & Rooney PC

(57) ABSTRACT

An applicator for cosmetics (in particular, eyeliner) and writing implements. The applicator includes an extrusion device that extrudes the content liquid to an applicator part. The applicator part has a conical part formed in an approximate conical shape. The conical part 31 has a plurality of thin disks arranged concentrically. The outside diameters of thin disks define a conical shape from a front end to a rear, and the thin disks is connected at their approximate center by an approximate cone or approximate cylinder. A plurality of grooves are formed in a front-to-rear direction of the applicator part. A liquid flow passage connected to a flow path is formed inside the approximate cone or approximate cylinder. Also, slits connecting the liquid flow passage and the grooves are formed on an outer side of the approximate cone or approximate cylinder.

13 Claims, 9 Drawing Sheets

(51) Int. Cl.

| | |
|---|---|
| ***B43K 8/02*** | (2006.01) |
| ***B43K 8/03*** | (2006.01) |
| ***B43K 8/04*** | (2006.01) |
| ***B43K 23/12*** | (2006.01) |

(56) References Cited

U.S. PATENT DOCUMENTS

| | | | |
|---|---|---|---|
| 5,899,622 | A | 5/1999 | Gueret |
| 7,384,208 | B2 | 6/2008 | Bouix et al. |
| 2002/0057939 | A1 | 5/2002 | Gueret |
| 2006/0216104 | A1 | 9/2006 | Bouix et al. |
| 2008/0205968 | A1 | 8/2008 | Malvar et al. |
| 2010/0232866 | A1 | 9/2010 | Umeno et al. |

FOREIGN PATENT DOCUMENTS

| | | | |
|---|---|---|---|
| JP | 10-94424 | A | 4/1998 |
| JP | 2002-205760 | A | 7/2002 |
| JP | 2005-118409 | A | 5/2005 |
| JP | 2007-236529 | A | 9/2007 |
| JP | 2008-534125 | A | 8/2008 |

OTHER PUBLICATIONS

International Search Report (PCT/ISA/210) mailed on Jul. 17, 2012, by the Japanese Patent Office as the International Searching Authority for International Application No. PCT/JP2012/061116.

International Preliminary Report on Patentability (Forms PCT/IB/373 and PCT/ISA/237) dated Oct. 29, 2013, issued by the International Bureau of WIPO in corresponding International Application No. PCT/JP2012/061116 with a English translation thereof. (4 pgs).

* cited by examiner

APPLICATOR

TECHNICAL FIELD

The present invention relates to an applicator used for cosmetics, stationery, daily life commodities and others, such as ink for writing implements and liquid cosmetics.

BACKGROUND ART

Conventionally, applicators comprised of a brush, a pen core or resin molding parts have been known.

Of these applicators, there is a known one which includes a liquid discharging mechanism that delivers a liquid sent out mechanically (by clicking or thrusting) from a liquid reservoir of a main body by way of a communication pipe connected to the liquid reservoir, to an applicator part connected with the communication pipe. Further, a brush-type applicator has a tapering (conical) shape so that its tip is used for makeup and provides suppleness in makeup actions and is characterized by being able to control fine lines and thick lines by adjusting the force to apply.

However, the brush type as one of the above-described applicators is expensive because the process of manufacturing is not easy. Further, since the brush type needs formation of a hole in the approximate central part in order to establish a liquid flow passage in the course of manufacturing, this process tends to generate a circular space in the tip of the brush, which produces splits in the brush tip, makes markedly difficult to keep the brush tip together and makes the liquid followability inconstant, resulting in lack of stability. Moreover, when the brush type applicator is used with a content liquid containing a shining material such as lame particles or others, there occurs the problem that the liquid tends to clog between fibers. In this way, these products have not been often satisfying.

As an applicator improved to solve the above problems, an applicator has been known which is an applicator for applying a liquid or semi-liquid product to a surface, for example, which comprises: a) a central core of an elongate shape along a longitudinal axis (X) and defining a porous structure allowing loading of said applicator by capillarity internally, said core having a free end; and b) a covering of flocking located around the central core, at least in proximity with said free end, said flocking allowing loading of said applicator by capillarity externally wherein the central core comprises one of a sintered plastic core, an elastomeric core, a ceramic core and a metal core, wherein the central core comprises a fibrous structure having fibers which are substantially directed along the longitudinal axis (X) of the applicator, wherein the covering of flocking comprises fibers directed at substantially right angles to the axis of the applicator (see Patent Document 1, for example).

2) Another known applicator is a flow-thru cosmetic dispenser for a flowable product comprising: a container having a reservoir that is capable of dispensing a flowable product through a container orifice; an applicator tip having a base and an external surface, the applicator tip may comprise a bristled brush, a comb, a sponge, a powder puff, a flocked substrate or a doe-foot; and a deformable, resilient conduit that defines a lumen which, in an undeformed state, is capable of conducting product between the reservoir and the applicator tip, but which in a deformed state is hindered from conducting product; the deformable conduit having proximal and a distal ends which define proximal and distal orifices of the lumen (see Patent Document 2, for example). 3) Still another known applicator is an extrusion application for cosmetic liquid, suitable for mascara, etc., comprising: a tubular shaft having a liquid chamber for accommodating a cosmetic liquid; an extrusion device having a rotary knob mounted to a rearward end portion of said tubular shaft, and a piston axially slidable in said tubular shaft with a rotation of said rotary knob; an applying part engaged with a forward end of said tubular shaft and provided forwardly of said liquid chamber, said applying part having a passage having a rearward end portion connected with said liquid chamber and a closed forward end portion; a plurality of radially extending projections spaced apart from each other at equal intervals on an outer periphery of said applying part, said projections being gradually reduced in diameter in the forward direction; at least one discharge hole formed between adjacent projections, said discharge hole being formed to connect with said passage; a slot extending from said discharge hole in forward and rearward directions and transverse to said projections; and a cap having an internal wall, wherein said internal wall is tapered in a forward direction according to a geometrical configuration defined by said projections gradually reduced in diameter in the forward direction (see Patent Document 3, for example).

However, the applicator for applying a liquid or semi-liquid product to a surface according to the above Patent Document 1 entails problems that its tip is poor in rigidity and starts to wear down right after application, which often makes it impossible to produce satisfying application of fine lines and achieve satisfying distance of application.

The flow-thru cosmetic dispenser according to the above Patent Document 2 entails problems that similarly to the above-mentioned brush type, the components such as the sponge, the powder puff, and the flocked substrate are likely to be clogged up with shining materials such as lame particles so that the content liquid becomes unable to be discharged.

The extrusion applicator for cosmetic liquid, suitable for mascara and others according to the above Patent Document 3 has problems that the applicator body formed of a resin molding is so high in rigidity that it is only suitable for liquids of low viscosity and is not suited for application to the skin.

PRIOR ART DOCUMENTS

Patent Documents

Patent Document 1: Japanese Patent Application Laid-open H10-94424 (Scope of Claims for Patent, FIG. 1, FIG. 2 and others)

Patent Document 2: Published Japanese translation of PCT international publication for patent application 2008-534125 (Scope of Claims for Patent, FIG. 9 and others)

Patent Document 3: Japanese Utility Model Application Laid-Open H05-91510 (Scope of Claims for Registered Utility Model, FIG. 3, FIG. 4 and others).

SUMMARY OF THE INVENTION

Problems to be Solved by the Invention

In view of the problems of the prior art and the status quo, the present invention is aimed at solving the above problems and to provide an applicator, which has suppleness of a brush, is suitable for application to the skin and still excellent in drawing fine lines with flexibility and retainability of the content liquid, can achieve a satisfactory long distance of application, and can be manufactured at as a low cost as a pen core.

Means for Solving the Problems

The present inventors have earnestly studies on the above prior art problems and resultantly found out that an applicator including: an applicator part having a mechanism for discharging or applying a content liquid; a reservoir being charged with the content liquid; and an extrusion device having a mechanism for extruding the content liquid to the applicator part, wherein a flow passage that connects between the applicator part and the reservoir is provided, and by extruding the content liquid inside the reservoir by means of the extrusion device, the content liquid is discharged from the applicator part as passing through the flow passage communicating between the applicator part and the reservoir, can achieve the above object, by configuring the applicator part in a specific shape and structure, and completed the present invention.

That is, the present invention resides in the following (1) to (8).

(1) An applicator comprising: an applicator part having a mechanism for discharging or applying a content liquid; a reservoir being charged with the content liquid; and a extrusion device having a mechanism for extruding the content liquid to the applicator part, wherein a flow passage that connects between the applicator part and the reservoir is provided, by extruding the content liquid inside the reservoir by means of the extrusion device, the content liquid is discharged from the applicator part as passing through the flow passage communicating between the applicator part and the reservoir, the applicator part has a conical part formed in an approximate conical shape, the conical part has a plurality of thin disks being arranged concentrically, the outside diameters of the thin disks define the conical shape from a front end to a rear, the thin disks are connected at the approximate center by an approximate cone or approximate cylinder, a plurality of grooves are formed in a front-to-rear direction of the applicator part, a liquid flow passage connected to the flow path, is provided inside the approximate cone or approximate cylinder, and, slits connecting the liquid flow passage and the grooves are provided on an outer side of the approximate cone or approximate cylinder.

(2) An applicator comprising: an applicator part having a mechanism for discharging or applying a content liquid; a reservoir being charged with the content liquid; and an extrusion device having a mechanism for extruding the content liquid to the applicator part, wherein a flow passage that connects between the applicator part and the reservoir is provided, by extruding the content liquid inside the reservoir by means of the extrusion device, the content liquid is discharged from the applicator part as passing through the flow passage communicating between the applicator part and the reservoir, the applicator part has a conical part formed in an approximate conical shape, a liquid flow passage connected to the flow path is provided inside an approximate cone or approximate cylinder, and, a slit connecting the liquid flow passage is formed on an outer side of the approximate cone or approximate cylinder.

(3) The applicator according to the above (1) or (2), wherein an electrostatic flocking process is performed on a surface of the applicator part.

(4) The applicator according to any one of the above (1) to (3), wherein the applicator part is formed of a material having rubber elasticity which comprises rubber or elastomer.

(5) The applicator according to the above (1), wherein the plurality of grooves are 0.1 to 1 mm wide and 0.05 to 2 mm deep.

(6) The applicator according to any one of the above (1) to (5), wherein an electrostatic flocking process is performed on a surface of the applicator, and the electrostatic flocking process adheres fibers having a fiber diameter of 0.05 to 0.7 mm and a fiber length of 0.05 to 1 mm.

(7) The applicator according to any one of the above (1) to (6), wherein, when the applicator part is fitted to a front barrel, the slit of the applicator part is formed in a position outside the front barrel.

(8) The applicator according to any one of the above (1) to (7), wherein an opening area for each slit is 0.5 to 2.0 $mm^2$.

Advantages of the Invention

According to the present invention, it is possible provide an applicator which has suppleness of a brush and is suitable for application to the skin and excellent in drawing fine lines, flexibility and retainability of the content liquid such as a liquid cosmetic, and can achieve a satisfactory long distance of application compared to the prior art, and can be manufactured at as a low cost as a pen core.

Further, formation of the applicator part with a material having rubber elasticity such as rubber or elastomer, makes it possible to provide a suitable rigidity for application actions. Further, electrostatic flocking process of the applicator part enables the content liquid to markedly improve in followability, and makes it possible to perform a further satisfactory application.

MODE FOR CARRYING OUT THE INVENTION

Now, the embodiment of the present invention will be detailed with reference to the drawings.

Figure 1:
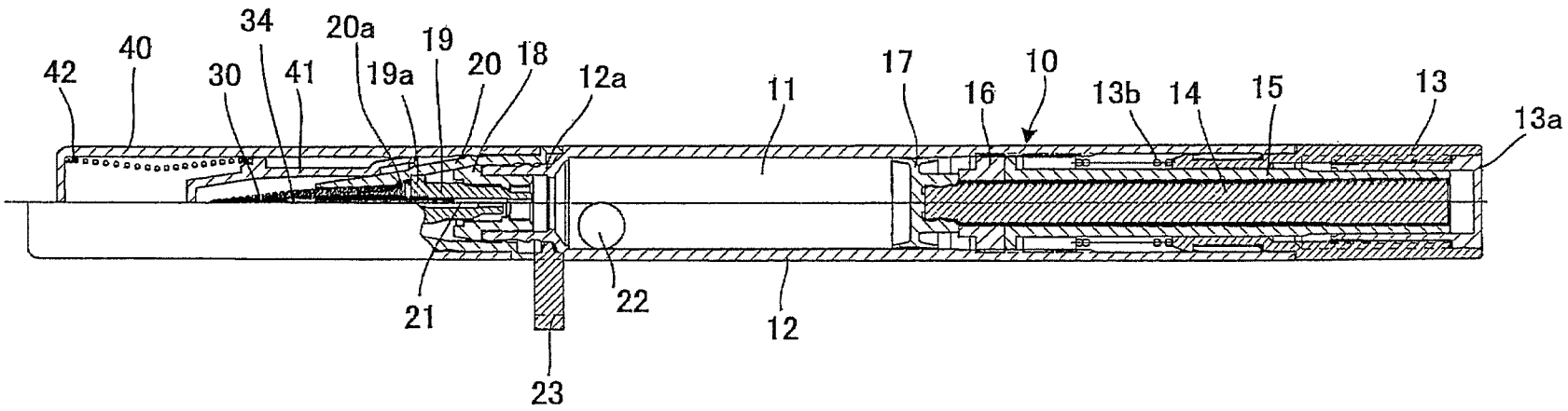
FIG. 1 is an illustrative diagram showing an overall section of an applicator according to the first embodiment of the present invention.

The applicator according to the first embodiment of the present invention is an applicator using an extrusion device of a twist-up advancing type for a liquid thrusting mechanism, and includes: as shown in FIG. 1, an applicator part 30 having a mechanism for discharging or applying a content liquid (which is a "liquid cosmetic" in this embodiment, and so forth); a reservoir 11 being charged with the content liquid; and extrusion device 10 having a mechanism for extruding the content liquid to applicator part 30. A flow passage 21 that connects between the applicator part 30 and reservoir 11 is formed so that, by extruding the content liquid inside the reservoir 11 by means of extrusion device 10, the content liquid is discharged from applicator part 30 as passing through the flow passage 21 communicating between applicator part 30 and reservoir 11.

Extrusion device 10 is configured to advance and feed the content liquid in container (reservoir) 11 to applicator part 30 by rotating an advancing member 13 arranged at the rear end of a barrel body 12, in a circumferential direction relative to barrel body 12.

This extrusion device 10 of the applicator includes advancing member 13 rotatably fitted at the rear end of barrel body 12, a drive sleeve 15 transmitting user's rotational force on advancing member 13 to a screw rod 14, a threaded part 16 fixed to barrel body 12 and screwed with screw rod 14, screw rod 14 engaging a piston body 17 rotatably at the front end thereof, and piston body 17 that slides inside reservoir 11 of barrel body 12. Rotation of advancing member 13 is transmitted to screw rod 14 by means of the drive sleeve 15. As this screw rod 14 rotates, the screw rod 14 and piston body 17 move forwards by the means of the female thread of nut-like threaded part 16 to advance the content liquid from reservoir 11 to applicator part 30.

As shown in FIG. 1, advancing member 13 is a cylindrical actuator which is closed with a crown 13*a* fitted in at the rear end thereof and is rotatably fitted and partly exposed in the rear end part of barrel body 12. Drive sleeve 15 is fitted inside advancing member 13 and fixed with respect to the rotational direction. Threaded part 16 is attached inside this drive sleeve 15 so as to be fixed in the rotational direction and relatively movable with respect to the axial direction (the threaded part itself does not move). Designated at 13*b* is a spring member, which urges advancing member 13 to be a rotary part rearwards (which urges a part called cam piece located under arrow 10 in FIG. 1 in the front direction).

In this applicator, a sealing part 18, joint member 19, front barrel 20 and applicator part 30 are assembled by push-in to the front end part 12*a* of barrel body 12. Reservoir 11 of barrel body 12 stores the content liquid. The content liquid advanced from the reservoir 11 passes through flow passage 21 inside joint member 19 to be discharged to applicator part 30 so as to be applicable. Further, front barrel 20 is formed so that a cap 40 can be attached thereto (fitted thereon) after use to cover applicator part 30 and front barrel 20.

Further, in FIG. 1, a reference numeral 22 in the drawing is an agitator ball that agitates the application liquid in reservoir 11 by its reciprocating motion. Designated at 41 and 42 are an inner cap inside cap 40 and a spring for urging the inner cap rearwards, respectively.

Further, a reference numeral 23 in the drawing is a stopper, which, having an annular part inserted between the rear end of the front barrel 20 and the front side at the stepped portion of front end 12*a* of barrel body 12, positions sealing part 18, joint member 19, front barrel 20 and applicator part 30 such as to shut off the flow passage of the application liquid toward applicator part 30 when the applicator is not in use. This stopper 23 is integrally formed of an annular piece having a partial cutout and a grip piece arranged on the opposite side of the cutout so that as the grip piece is pulled out the annular part becomes greater in diameter thanks to the cutout part and the stopper can be disengaged from between the rear end of the front barrel 20 and front end part 12*a* of barrel body 12.

As shown in FIG. 1, when the applicator is not in use, an unillustrated sealing ball fits into a bore of sealing part 18 to be the sealing ball socket and seals so that the content liquid will not flow into the applicator part 30 side. On the other hand, when the applicator is in use, the user pulls out stopper 23 from barrel body 12 and pushes front barrel 20 toward the rear side, whereby the small-diametric portion at the rear end of joint member 19 abuts the unillustrated sealing ball. Then, the sealing ball is dislodged from the bore of sealing part 18 to go into the reservoir 11, whereby the content liquid inside the reservoir 11 flows into a liquid flow passage 34 of applicator part 30 through the bore of joint member 19 and is supplied to applicator part 30 from its interior so that the liquid can be applied to the target area.

Figure 2:
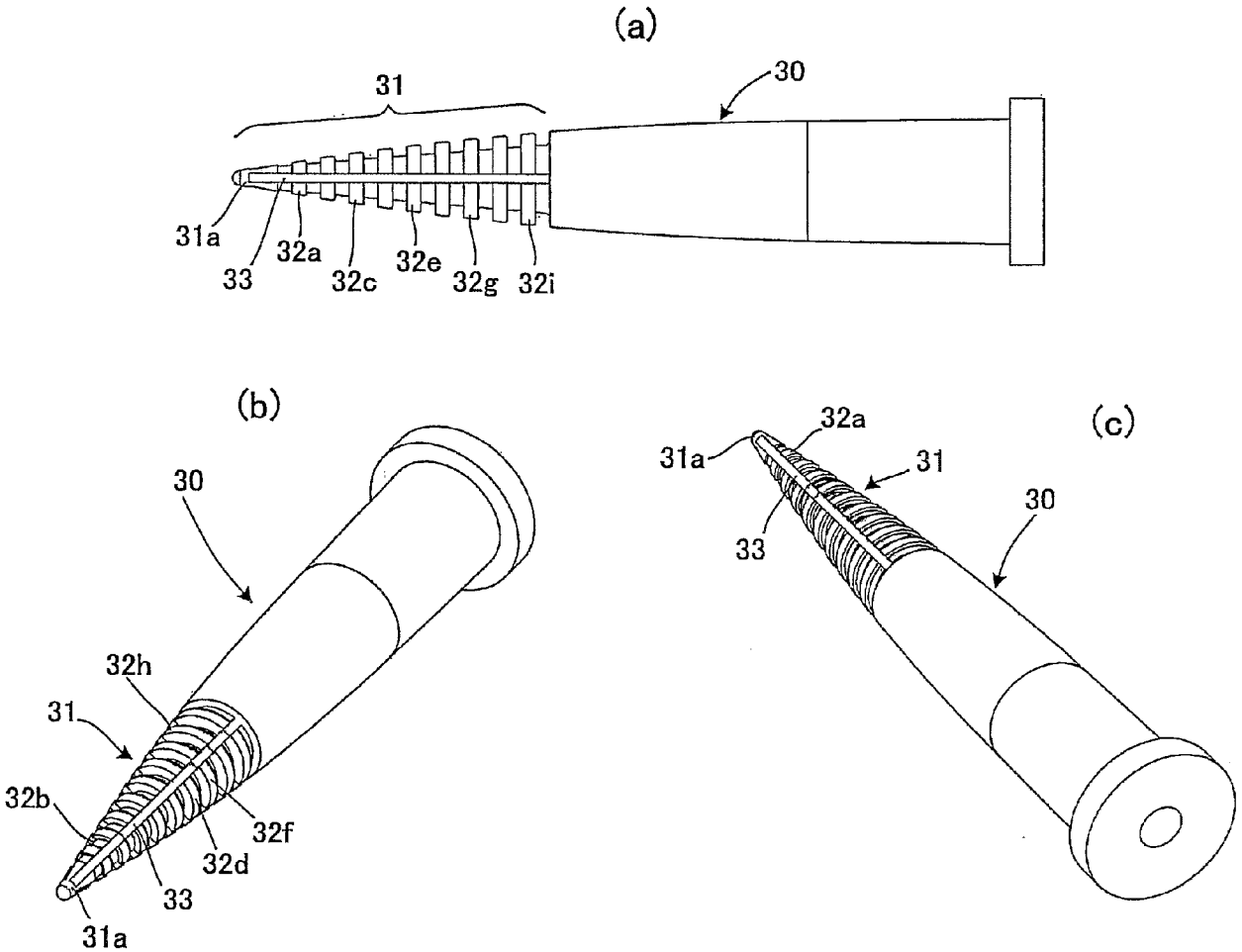
FIG. 2 is an illustrative diagram of an applicator part in the applicator of FIG. 1, (*a*) a front view, (*b*) a front perspective view and (*c*) a rear perspective view.
Figure 3:
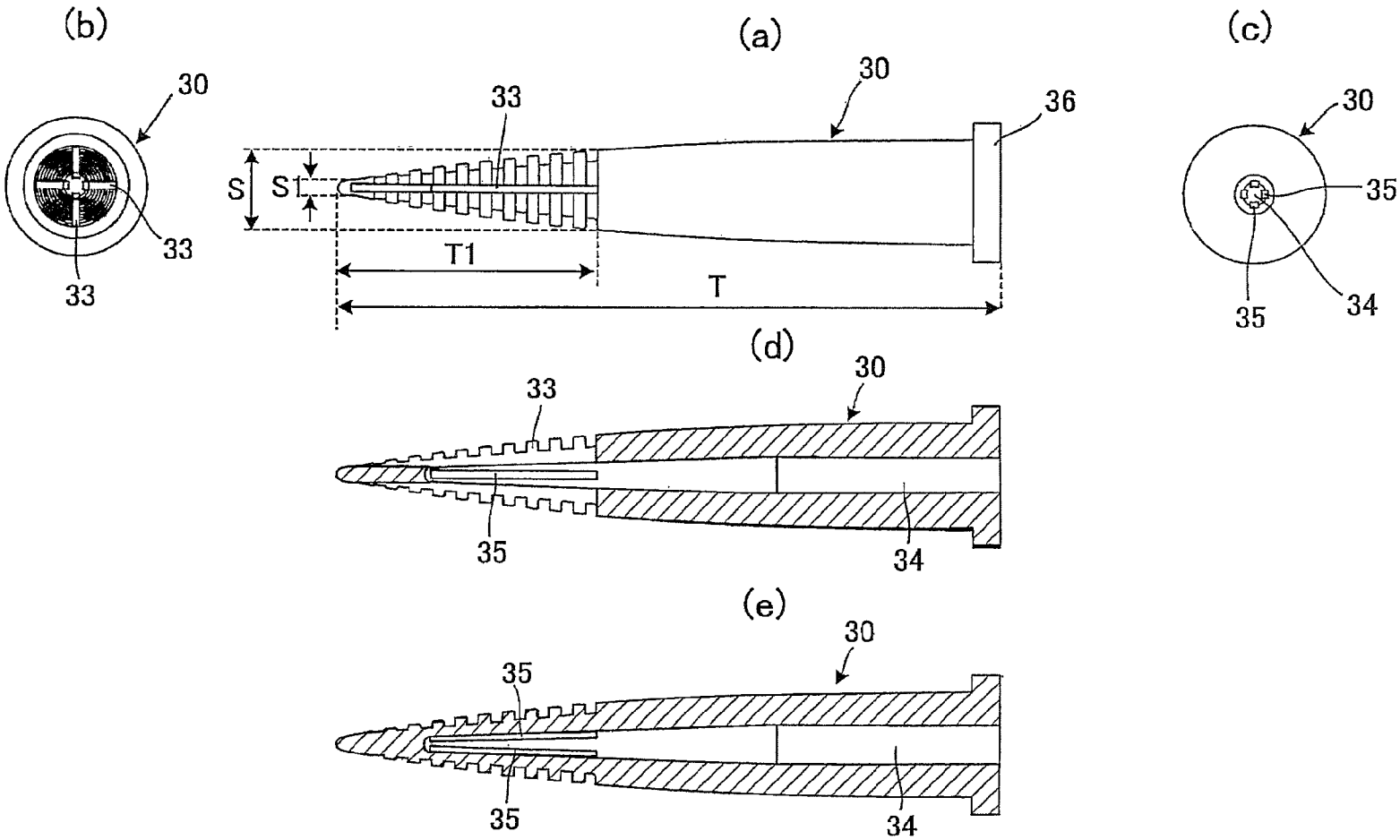
FIG. 3 is an illustrative diagram of an applicator part in the applicator of FIG. 1, (*a*) a left side view, (*b*) a front view, (*c*) a partial sectional view, (*d*) an overall sectional view and (*e*) a right side view.
Figure 4:
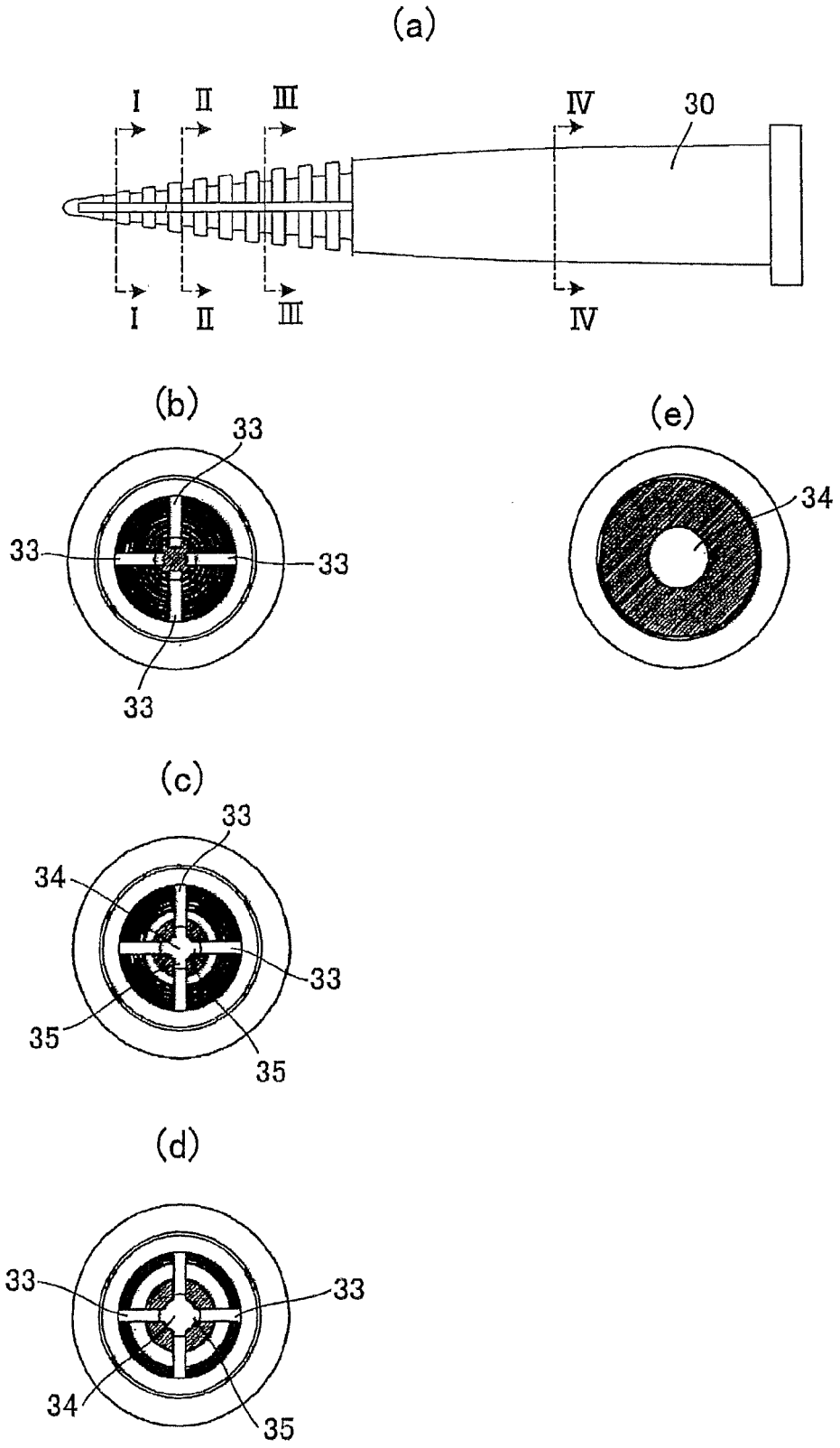
FIG. 4 is an illustrative diagram for explaining the sectional view of the applicator part in the applicator of FIG. 1, cut along lines, (*a*) a front view, (*b*) a sectional view cut along line I-I, (*c*) a sectional view cut along line II-II, (*d*) a sectional view cut along line and (*e*) a sectional view cut along line IV-IV.

Applicator part 30 in the applicator of the present invention has an approximately conical overall configuration from the front to the rear with a conical part 31 formed on the front side, as shown in FIGS. 2 to 4. A plurality of thin disks 32*a*, 32*b* . . . 32*i* (nine thin disks are integrally formed in the present embodiment) are concentrically arranged at intervals of a predetermined distance from the front end 31*a* of this conical part 31, the outside diameters of the thin disks 32*a*, 32*b* . . . 32*i* are defining a conical shape from front end 31*a* to be the application tip rearwards, as shown in FIGS. 2(*a*) to 2(*c*).

In order to suitably retain the content liquid between thin disks 32*a*, 32*b* . . . 32*i*, these thin disks 32*a*, 32*b* . . . 32*i* are preferably of 0.2 to 0.4 mm wide while the intervals between front end 31*a* and the thin disk and between the thin disks are preferably formed to be preferably 0.2 to 0.4 mm.

These thin disks 32*a*, 32*b* . . . 32*i* are connected at their approximate center by an approximate cone (or approximate cylinder). Further, in order to make the content liquid reach the front end, a plurality of depressed grooves 33 (four at intervals of a predetermined angle (90°) in the present embodiment) are provided on the outer peripheral side across thin disks 32*a*, 32*b*, . . . 32*i* and its front end 31*a* of applicator 30, as shown in FIGS. 2 to 4. Formed inside the approximate conical part 31 to be an interior of the applicator part or is a liquid flow passage 34 that communicates with flow passage 21 inside joint member 19, the liquid flow passage being tapered toward the front side similarly to the conical part. Further, slits (openings) 35 that establish communication between the liquid flow passage 34 and the four grooves 33 are provided on the outer side of the approximate cone (or approximate cylinder), as shown in FIGS. 3 and 4.

The groove 33 is preferably 0.1 to 1 mm wide, 0.05 to 2 mm deep and 1 to 5 mm long so as to provide a suitable amount of discharge and a suitable amount of application. Further, the width of slit (opening) 35 that connects between the liquid flow passage 34 and groove 33 is preferably equal to or smaller than the width and length of groove 33. In particular, the area of the opening for each slit 35 is preferably 0.5 to 2.0 $mm^2$.

The outside diameter of applicator part 30 and the inside diameter of liquid flow passage 34 in the present embodiment may vary depending on the application target, the type of content liquid and other factors. For cosmetic purposes such as eye makeup, it is preferred that the maximum outside diameter S of the conical part in applicator part 30 is 4 to 6 mm, the outside diameter S1 at the distal end is 0.2 to 2 mm, the length T of the applicator part is 5 to 10 mm, the length T1 of conical part 31 is 3 to 10 mm, the inside diameter of liquid flow passage 34 is 0.8 to 3 mm.

The thus configured applicator part 30 may be integrally formed of a material such as rubber, plastic and elastomer. In view of suppleness of a brush, making it suitable for application to the skin, making it easy to draw fine lines and keep flexibility and producing a suitable rigidity for application actions, the applicator part is integrally formed of a material of rubber elasticity, such as rubber or elastomer of silicone, styrene, olefin, urethane or polyester. Applicator part 30 of this configuration is fitted into front barrel 20, and rear flange part 36 is fixed by being held between a rear step 20*a* of front barrel 20 and front end part 19*a* of joint member 19.

As the content liquid stored in reservoir 11 of the applicator of the present invention, various kinds of content liquids may be used depending on the mode of the applicator. Other than liquid cosmetics, liquids such as ink for writing implements may be used and the composition and others of the liquid should not be particularly limited.

In the present embodiment, the content liquid employs a liquid cosmetic which, at least comprises carbon black, water, 0.5 to 5 mass % of a dispersing agent formed of a film-forming resin, 2 to 15 mass % of a film-forming agent (solid content conversion) and 0.5 mass % or lower of a surfactant, and has a viscosity at a temperature of 25 deg. C. and at a shear velocity of 3.83 $S^{-1}$ in an ELD type viscometer, falling within the range of 2 to 8 mPa·s.

The carbon black being used is made use for coloring purposes, so that any type of carbon black can be used and should not be particularly limited as long as it is usually used as a coloring agent for liquid cosmetics of black color.

The carbon black content is preferably 1 to 20 mass %, or more preferably 5 to 15 mass % relative to the total amount of the liquid cosmetic.

The dispersing agent being used is formed of a film-forming resin, aiming at improving dispersibility of carbon black as a coloring matter and also functioning as a resin for film formation.

The usable dispersing agent is not particularly limited as long as it has the above functions. Examples include copolymers of one or more kinds selected from acrylic acid, methacrylic acid, alkyl esters or derivatives of these, vinyl acetate and vinylpyrrolidone; betaine-type alkyl acid ampholytic resins and the like. In view of better dispersibility of carbon black, a copolymer of vinyl acetate with one kind selected from acrylic acid, methacrylic acid, alkyl esters or derivatives of these; a copolymer of vinylpyrrolidone and vinyl acetate; a copolymer of octyl acrylamide with one or more kind selected from acrylic acid, methacrylic acid, or alkyl esters of these, are preferably used. Particularly preferably, in view of better dispersibility and film-forming performance, a copolymer of octyl acrylic amide with one or more kind selected from acrylic acid, methacrylic acid, or alkyl esters of these, is preferably used.

The content of these dispersing agents is preferably 0.5 to 5 mass % or more preferably 2 to 4 mass %, relative to the total amount of the liquid cosmetic.

As the film-forming agent being used, examples include emulsion resins of copolymers of one or more kinds of monomers, selected from acrylic acid, methacrylic acid, alkyl esters or derivatives of these, styrene and vinyl acetate.

It should be noted that the above dispersing agent is also formed of film-forming resin, but difference from the dispersing agent is that the former is the soluble resin and the latter is the emulsion resin. The emulsion resin is an aqueous suspension obtained by emulsion polymerizing monomers in water as the polymerization solvent. In dispersion of carbon black, a more stable carbon black-dispersed liquid can be obtained when using a soluble resin than using an emulsion resin. From this point of view, these two are used distinctively.

The content of the film-forming agent (emulsion resin) is preferably 2 to 15 mass % in solid content (resin content) conversion, relative to the total amount of the liquid cosmetic. Further, 2 to 10 mass % is more preferable.

Though a surfactant is used to stabilize these film-forming agents (emulsion resin), the surfactant blended with these will little affect adherence in the present embodiment, so that this component will not be considered as a content.

The surfactant being used has a function of assisting dispersion in dispersing carbon black, examples including nonionic surfactants, anionic surfactants, cationic surfactants. For example, lecithin, propyleneglycol fatty acid ester, glycerin fatty acid ester, polyglycerin fatty acid ester, and in addition, one or more kinds of mixtures selected from polyoxyethylene alkyl ether, polyoxyethylene polyoxypropylene alkyl ethers, polyoxyethylene alkyl ether phosphate.phosphate salts, polyethyleneglycol fatty acid esters, alkyl sulfate salts, sulfonate salts and polyoxyethylene alkyl ether sulfate salts, can be listed.

The content of the surfactants is preferably 0.5 mass % or lower, or more preferably 0 to 0.3 mass %, relative to the total amount of the liquid cosmetic.

The liquid cosmetic of the present embodiment uses water (inclusive of purified water, distilled water, deionized water, pure water, hyperpure water and the like) as a solvent. The content of water corresponds to the remaining part other than the contents of the above components and the aftermentioned arbitrary components.

Further, this liquid cosmetic can contain arbitrary additives that are used for ordinary liquid cosmetics other than the above essential components. Specifically, the cosmetic can contain components such as preservatives, antioxidant, neutralizers, UV absorbers, chelating agents, moisturizing agents, beautification ingredients, perfumes, and viscosity adjustors, as appropriate within the range in which the effect of the present invention is not spoiled.

Further, the liquid cosmetic of the present embodiment should have a viscosity at a temperature of 25 deg. C. and at a shear rate of 3.83 $S^{-1}$ in an ELD type viscometer, falling within the range of 2 to 8 mPa·s, more preferably 3 mPa·s to 6 mPa·s. Specifically, as to the condition of measuring the values of viscosity (including the examples below), measurement was performed by an ELD type viscometer, a product of Tokimec Inc., at 25 deg. C. and at a shear rate of 3.83 $S^{-1}$ using a standard cone rotor with a speed of 1 rpm.

In the thus configured applicator of the present embodiment, the liquid cosmetic etc. to be the content liquid is extruded from reservoir 11 by means of extrusion device 10, passes through flow passage 21 inside joint member 19 and enters liquid flow passage 34 of applicator part 30 so as to be discharged from slits 35 of applicator part 30 to grooves 33.

Thereafter, the content liquid is held in gaps between front end 31*a*, thin disks 32*a*, 32*b* . . . 32*i* by capillary force. At the same time, the retained content liquid enters grooves 33 that are connected to and formed on the outside surface, thanks to capillary force and reaches the end of each groove 33 provided on the front end 31*a* of the applicator part. As a result, it becomes possible to apply the content liquid by applying the liquid having reached at the front end to the target surface. With further continuation of application, the content liquid stored between thin disks 32*a*, 32*b* . . . 32*i* moves to the front end of the applicator by the process of capillary force, thus making it possible to achieve a satisfactory distance of application by a single action. Further, this applicator part has suppleness of a brush and is suitable for application to the skin. Moreover, this configuration makes the applicator part excellent in drawing fine lines, flexibility and retainability of the content liquid such as a liquid cosmetic and enables sufficient retention of the content liquid between thin disks 32*a*, 32*b* . . . 32*i*, so that it is possible to achieve a satisfying distance of application compared to the prior art, and still can be integrally formed. Accordingly, it is possible to provide an applicator that can be manufactured at as a low cost as a pen core.

Further, adoption of the above-mentioned soft plastic material such as rubber and elastomer for the applicator part enhances capillary force because of its flexion during application. Further, the outside diameter of conical part 31, the number and dimensions of thin disks 32*a*, 32*b* . . . 32*i*, the width, depth and number of grooves and the slit width may be adjusted as appropriate, whereby it becomes possible to suitably adjust the amount of discharge, the amount of content liquid to be retained, the distance of application, the amount of application, the width of application and the like.

Figure 5:
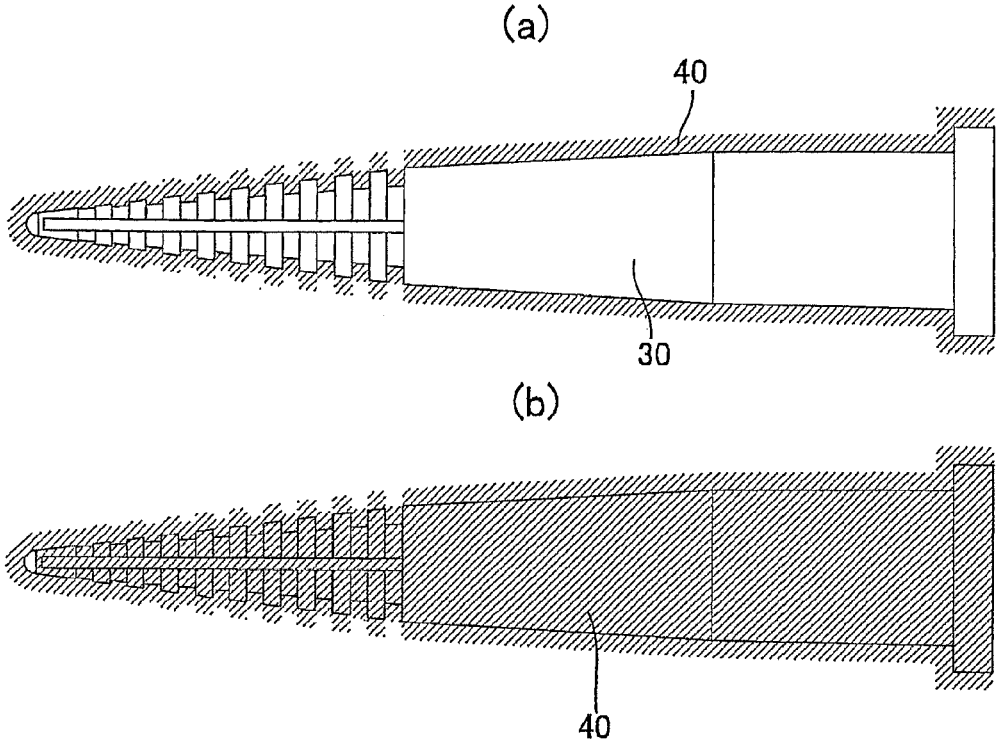
FIG. 5 is an illustrative diagram of the applicator part in the applicator of FIG. 1, having been treated with an electrostatic flocking process, (*a*) a view showing a sectional state and (*b*) a front view.

The applicator of the present invention can produce the above advantageous effects and it is preferable that the entire surface of applicator part 30 is treated by an electrostatic flocking process (flocky processing) 40, as shown in FIGS. 5(*a*) and 5(*b*).

This electrostatic flocking process is preferably performed by adhering fibers having a fiber diameter of 0.05 to 0.7 mm and a fiber length of 0.05 to 1 mm. As the fiber materials, resin fibers such as, for example nylon, rayon, acryl, and, polyester can be used.

In addition to the above effects and others, the application with an applicator part 30 treated with electrostatic flocking process (flocky processing) 40 done on the entire surface thereof makes it possible to achieve further satisfactory application thanks to the effect of the capillary force of the electrostatic flocking process on the entire surface of applicator part 30 even if the content liquid is poor in wettability due to its physical properties.

Figure 6:
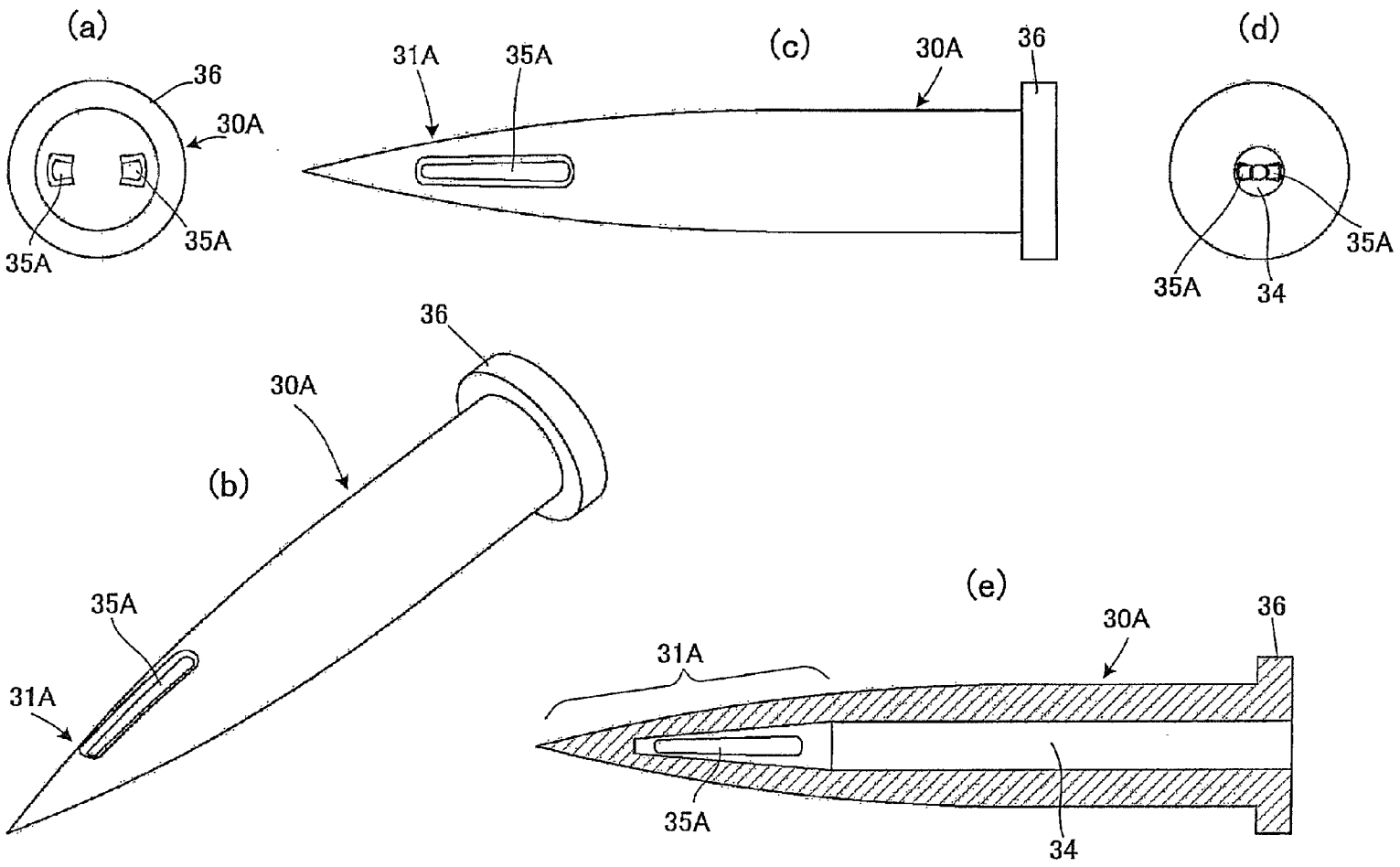
FIG. 6 is an illustrative diagram of an applicator part in an applicator according to the second embodiment of the present invention, (*a*) a left side view, (*b*) a perspective view, (*c*) a plan view, (*d*) a right side view and (*e*) a sectional view.
Figure 7:
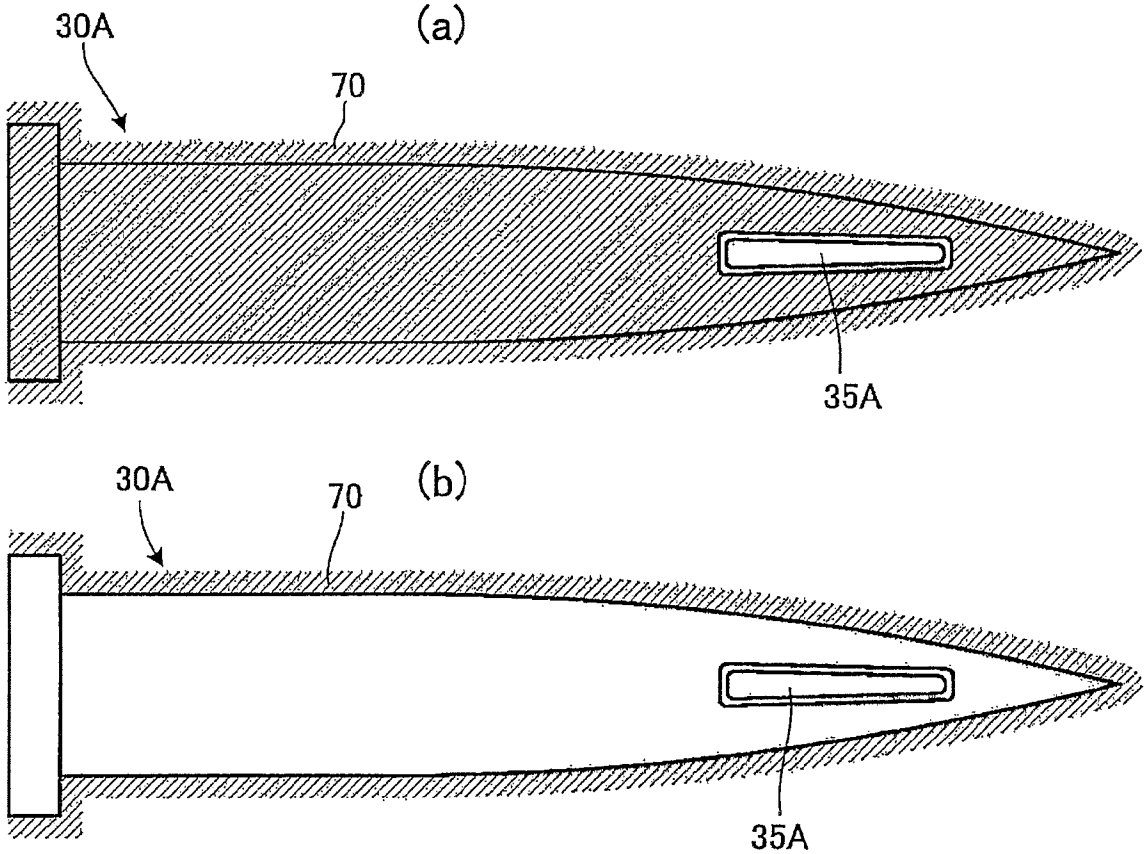
FIG. 7 is an illustrative diagram of the applicator part in the applicator of FIG. 6, having been treated with an electrostatic flocking process, (*a*) a front view and (*b*) a view showing a sectional state.

FIGS. 6 and 7 show an applicator part 30A of the second embodiment. The difference from the applicator part of the first embodiment resides in that instead of forming thin disks on a conical part 31A on the front side, fiber hairs 70 are formed on the entire outer peripheral surface by an electrostatic flocking process while a slit 35A that passes through from the outer peripheral surface to the interior liquid passage is formed while the front end of applicator 30A is formed with conical part 31A. Further, though the rear part of applicator part 30A is covered by front barrel 20, slit 35A is formed on the outer side of conical part 31A in front of front barrel 20. Other components are the same as those in applicator part 30 used in the applicator of the first embodiment shown in FIGS. 1 to 5, the same components are allotted with the same reference numerals.

Though applicator part 30A according to the second embodiment has no thin disk as in applicator part 30 of the first embodiment, fiber hairs 70 are electrostatically flocked in the applicator part 30A as shown in FIG. 7. Accordingly, the application liquid can be efficiently retained by fiber hairs 70 on the applicator part 30A surface, so that conical part 31A is well wetted with the application liquid, making application easy, and thus making it possible to discharge and apply an ample amount of application liquid to the target area.

Further, in conical part 31A, a pair of slits 35A are formed at the opposed positions. The number of slits 35A are not particularly specified, but it is preferable that the slits are arranged radially uniformly. The area of the opening of each slit 35A is preferably 0.5 to 2.0 $mm^2$. If the area of the opening is smaller than 0.5 $mm^2$, the application liquid cannot be discharged sufficiently, whereas the opening with an area exceeding 2.0 $mm^2$ will flow out the application liquid wastefully, resulting in being unpreferable.

The applicator of the present invention should not be limited to the above embodiment, but various changes can be made as appropriate without departing from the spirit and scope of the present invention.

The applicator of the present invention is characterized by the shape and structure of applicator part 30, so that other architecture may be adopted as appropriate for those other than the configuration of the applicator part.

For example, in the above embodiment the applicator has been described taking an example of an applicator for liquid eyeliner and liquid eye shadow. However, the present invention should not be limited to this, and can not only be applied to eyebrow applicators for drawing lines on eyebrows, and for drawing lines on the skin and lips, but also to writing implements capable of drawing fine lines by using ink for writing implements as the application liquid.

Further, as the extrusion device to be the liquid thrusting mechanism for the liquid applicator of the above embodiment, the applicator of a twist-up advancing type shown in FIG. 1 is used. However, for example, an applicator of a click-advancing type shown in FIG. 8 may be used.

Figure 8:
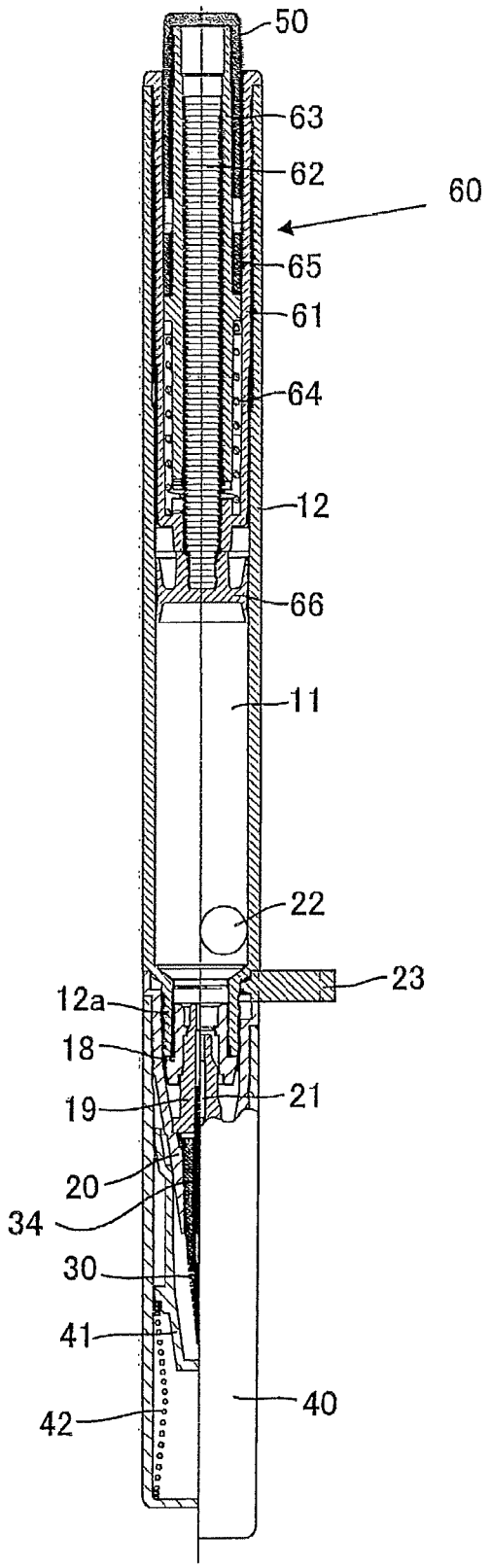
FIG. 8 is an illustrative diagram showing an overall section of an applicator when the extrusion device as a liquid thrusting mechanism of the applicator of the present invention is replaced with another embodiment.

FIG. 8 is an illustrative diagram of a click advancing type applicator. Here, in FIG. 8, the same components as in the above embodiment are allotted with the same reference numerals without description.

The applicator of a click-advancing type according to this embodiment, can advance a content liquid in reservoir 11 by pushing a click member 50 arranged at the rear end of barrel body 12 forwards in the axial direction as shown in FIG. 8, includes: a clicking mechanism portion 60 for converting the pushing force of user's clicking on click member 50 into a rotational force by means of a cam mechanism; and a threaded body 61 fixed to barrel body 12; and a screw rod 62 screwed with threaded body 61, and is constructed such that screw rod 62 is rotated by the rotational force converted by the clicking device 60 and moved forwards through threaded body 61 to thereby advance the application liquid. The clicking mechanism portion 60 for converting the pushing force on clicking member 50 into rotational force is essentially composed of a rotary part 63 having first and second cam surfaces, threaded body 61 having a first fixed cam surface and a cam body 65 having a second fixed cam surface.

In this click advancing type applicator, as a click is started by pushing clicking member 50 in the axial direction, clicking member 50 and rotary part 63 integrally move forwards as compressing a spring member 64. As clicking is further continued, rotary part 63 moves forwards whilst it is rotating in a predetermined direction. During this, since rotary part 63 is rotatably attached to clicking member 50, clicking member 50 itself will not rotate. With the rotation of rotary part 63 at the time of clicking, screw rod 62 which is restrained from rotating relative to rotary part 63 and freely moves in the axial direction, rotates together with rotary part 63. Screw rod 62 moves forwards together with a piston body 66 by the function of its screw engagement with threaded body 61 to thereby advance the content liquid in reservoir 11. From this state, clicking is released. Spring member 64 disposed inside threaded body 61 pushes up rotary body 63 to thereby release clicking. At this point, rotary body 63 starts rotating in the predetermined rotational direction and moving backwards. As release of clicking is further continued, the push-up force of spring member 64 also moves rotary body 63 backward whilst it is rotating. Also during this rotation, screw rod 62 is rotated as stated above and moved forwards together with piston body 66 to thereby advance the application liquid. When this clicking action is repeated, the clicking action and releasing action in the axial direction are converted to rotational force so as to rotate screw rod 62, whereby piston body 66 is pushed forwards so as to be able to advance a predetermined amount of the content liquid.

Figure 9:
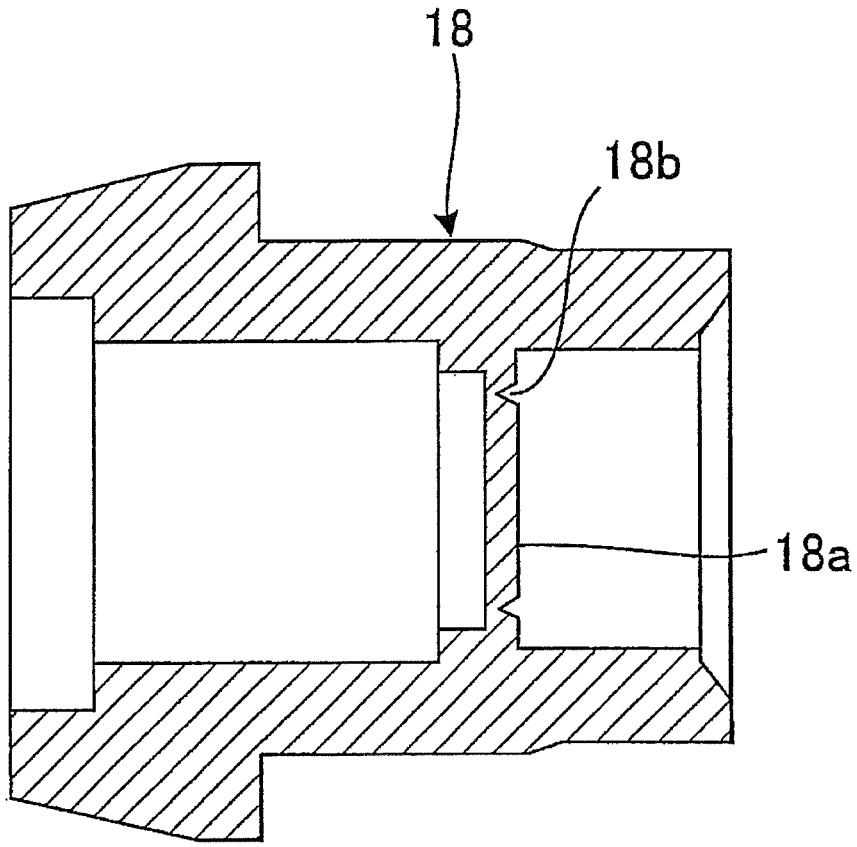
FIG. 9 is an illustrative diagram showing an overall section of a sealing part when the sealing part of the applicator of the present invention is replaced with another embodiment.

Further, in each liquid applicator of the embodiments shown in FIG. 1 and FIG. 8, in order to seal joint member 19, an unillustrated sealing ball is used in combination with sealing part 18 as a sealing ball socket. However, for example, it is possible to provide an annular thin film 18*a* to be a sealing member, integrally inside sealing part 18 as shown in FIG. 9, and use it in place of the sealing ball.

In this configuration, when the applicator is not in use, annular thin film 18*a* seals the liquid flow passage 21 inside sealing part 18 so that the application liquid will not flow into the applicator part 30 side. On the other hand, when the applicator is in use, the user pulls out stopper 23 from barrel body 12 and pushes front barrel 20 toward the rear side similarly to the above embodiment, whereby the small-diametric portion at the rear end of joint member 19 abuts annular thin film 18*a* so that annular thin film 18*a* is dislodged in part from the bore of sealing ball socket 18 by the function of a cutout groove (V-shaped groove in section) 18*b* formed along the circumference of annular thin film 18*a*. As a result, the application liquid inside the reservoir 11 flows into liquid flow passage 34 of applicator part 30 through the bore of joint member 19 and is supplied to applicator part 30 from its interior so that the liquid can be applied to the target area in the above-mentioned embodiment.

EXAMPLES

Next, the present invention will be further detailed taking examples, but the present invention should not be limited to the following examples and others.

Example 1

An applicator was prepared in conformity with FIG. 1, using an applicator part having the following dimensions and the like, based on FIGS. 2 to 4 below.

(Configuration of Applicator Part)

An applicator part was integrally formed of styrene elastomer (trade name: ACTYMER, a product of RIKEN TECHNOS CORP.), using an injection molding die, in the following specifications:—

Maximum outside diameter S of the conical part: ϕ2.7 mm, outside diameter S1 at the front end: ϕ0.4 mm, length T of the applicator part: 17 mm, length T1 of conical part 31: 6.7 mm, inside diameter of the liquid flow passage: ϕ1 mm, groove width 0.3 mm, depth 0.3 mm, length 6.2 mm, slit: width 0.2 mm, length 4 mm, thin disks: thickness 0.3 mm, pitch 0.3 mm, 9 disks.

As the content liquid, each of liquid cosmetics shown in composition examples 1-7 in Table 1 below, was charged in an amount of 1.4 ml into the applicator.

TABLE 1

(Total Amount 100 mass %)

| Kind of Blending Composition | Specific Compound Name | Composition Example 1 | Composition Example 2 | Composition Example 3 |
|---|---|---|---|---|
| Pigment | Carbon black | 10 | 10 | 10 |
| Dispersing Agent | Vinyl Acetate-Vinylpyrrolidone Copolymer | 0.8 | 0 | 4.5 |
| Dispersing Agent | Vinylpyrrolidone-Acrylic Dimethylaminopropyl Acrylamide Copolymer | 0 | 3 | 0 |
| Dispersing Agent | Acrylic Octylacrylamide-acrylic Acid Ester Copolymer | 0 | 0 | 0 |
| Dispersing Agent | Betine-type Alkyl Acid Ampholytic resin (other resin) | 0 | 0 | 0 |
| Surfactant | Polyoxyethylene Behenyl Ether | 0 | 0 | 0 |
| Surfactant | Polyethyleneglycol monostearate | 0 | 0 | 0 |
| Film-forming Agent Emulsion | Alkyl Acrylate Copolymer Emulsion*1 | 20 | 15 | 10 |
| (Resin Component in Emulsion) | | 10 | 7.5 | 5 |
| Neutralizer | Aminomethylpropanol | 0.1 | 0.3 | 0.5 |
| Chelating Agent | Disodium ethylenediaminetetraacetate | 0.3 | 0.3 | 0.3 |
| Moisturizing Agent | 1,3-Butylene Glycol | 8 | 8 | 8 |
| Preservative | Methylparaben | 0.4 | 0.4 | 0.4 |
| Preservative | Sodium Dehydroacetate | 0.1 | 0.1 | 0.1 |
| Purified Water | Purified Water | Residue | Residue | Residue |
| Viscosity (mPa · s) | Shear Rate 3.83(S−1) | 6 | 5 | 6 |

| Kind of Blending Composition | Specific Compound Name | Composition Example 4 | Composition Example 5 |
|---|---|---|---|
| Pigment | Carbon black | 10 | 10 |
| Dispersing Agent | Vinyl Acetate-Vinylpyrrolidone Copolymer | 0 | 4.5 |
| Dispersing Agent | Vinylpyrrolidone-Acrylic Dimethylaminopropyl Acrylamide Copolymer | 3 | 0 |
| Dispersing Agent | Acrylic Octylacrylamide-acrylic Acid Ester Copolymer | 0 | 0 |
| Dispersing Agent | Betine-type Alkyl Acid Ampholytic resin (other resin) | 0 | 0 |
| Surfactant | Polyoxyethylene Behenyl Ether | 0.3 | 0 |
| Surfactant | Polyethyleneglycol monostearate | 0 | 0.5 |

TABLE 1-continued

| | | | (Total Amount 100 mass %) |
|---|---|---|---|
| Film-forming Agent Emulsion | Alkyl Acrylate Copolymer Emulsion*1 | 15 | 10 |
| (Resin Component in Emulsion) | | 6.75 | 4.5 |
| Neutralizer | Aminomethylpropanol | 0.3 | 0.5 |
| Chelating Agent | Disodium ethylenediaminetetraacetate | 0.3 | 0.3 |
| Moisturizing Agent | 1,3-Butylene Glycol | 8 | 8 |
| Preservative | Methylparaben | 0.4 | 0.4 |
| Preservative | Sodium Dehydroacetate | 0.1 | 0.1 |
| Purified Water | Purified Water | Residue | Residue |
| Viscosity (mPa · s) | Shear Rate 3.83(S−1) | 4 | 4 |

| Kind of Blending Composition | Specific Compound Name | Composition Example 6 | Composition Example 7 |
|---|---|---|---|
| Pigment | Carbon black | 10 | 10 |
| Dispersing Agent | Vinyl Acetate-Vinylpyrrolidone Copolymer | 0 | 0 |
| Dispersing Agent | Vinylpyrrolidone-Acrylic Dimethylaminopropyl Acrylamide Copolymer | 0 | 0 |
| Dispersing Agent | Acrylic Octylacrylamide-acrylic Acid Ester Copolymer | 3 | 0 |
| Dispersing Agent | Betine-type Alkyl Acid Ampholytic resin (other resin) | 0 | 3 |
| Surfactant | Polyoxyethylene Behenyl Ether | 0 | 0 |
| Surfactant | Polyethyleneglycol monostearate | 0 | 0 |
| Film-forming Agent Emulsion | Alkyl Acrylate Copolymer Emulsion*1 | 15 | 15 |
| (Resin Component in Emulsion) | | 7.5 | 6.75 |
| Neutralizer | Aminomethylpropanol | 0.3 | 0.3 |
| Chelating Agent | Disodium ethylenediaminetetraacetate | 0.3 | 0.3 |
| Moisturizing Agent | 1,3-Butylene Glycol | 8 | 8 |
| Preservative | Methylparaben | 0.4 | 0.4 |
| Preservative | Sodium Dehydroacetate | 0.1 | 0.1 |
| Purified Water | Purified Water | Residue | Residue |
| Viscosity (mPa · s) | Shear Rate 3.83(S−1) | 3 | 7 |

*1Copolymer Emulstion consisting of two or more components selected from acrylic acid, methacrylic aic and C1-C4 and C8 Alkylesters of these As the liquid cosmetic (each liquid cosmetic of composition examples 1-7) was pushed out by an advancing operation using the prepared applicator, the liquid cosmetic was discharged from the grooves and retained between the thin disks by capillary force, at the same time the retained content liquid was reached the ends of the grooves formed on the connected outer surface by capillary force. When the content liquid arriving at the end was applied to the application target surface, i.e., around the eyes, suppleness like a brush and suitable application to the skin were obtained. Still more, the applicator was excellent in drawing fine lines and flexibility, and could produce a satisfactory long distance of application, compared to the prior art.

Example 2

The entire surface of the applicator part prepared in the above example 1 was treated by an electrostatic flocking process with nylon fibers having a fiber diameter of 0.3 mm and a fiber length of 0.8 mm (in conformity with FIG. 5). The applicator used was the clicking type applicator shown in FIG. 8.

As the content liquid, each of liquid cosmetics shown in composition examples 1-7 in Table 1 above, was charged in an amount of 1.4 ml into the applicator.

As the above-composed liquid cosmetic (each liquid cosmetic of composition examples 1-7) was pushed out by a clicking operation using the prepared applicator having the electrostatically flocked applicator part, the liquid cosmetic was discharged from the grooves and retained between the thin disks by capillary force, at the same time the retained content liquid was reached the ends of the grooves formed on the connected outer surface by capillary force and also reached the electrostatically flocked fibers. When the content liquid arriving at the ends treated by the electrostatic flocking was applied to the application target surface, i.e., around the eyes, suppleness like a brush and suitable application to the skin were obtained. Still more, the applicator was excellent in drawing fine lines and flexibility, and could produce a satisfactory long distance of application, compared to the prior art.

Example 3

An applicator was prepared in conformity with FIG. 1, using an applicator part having the following dimensions and the like, based on FIG. 7 below.

(Configuration of Applicator Part)

An applicator part was integrally formed of styrene elastomer (trade name: ACTYMER, a product of RIKEN TECHNOS CORP.), using an injection molding die, in the following specifications:—

Maximum outside diameter S of the conical part: ϕ2.5 mm, length T of the applicator part: 14.6 mm, length T1 of the conical part: 9.6 mm, inside diameter of the liquid flow passage: ϕ1 mm, two slits having a slit opening area of 0.975 mm2.

Further, the entire surface of the applicator part was treated by an electrostatic flocking process with nylon fibers having a fiber diameter of 0.3 mm and a fiber length of 0.8 mm.

As the content liquid, each of liquid cosmetics shown in composition examples 1-7 in Table 1 above, was charged in an amount of 1.4 ml into the applicator.

INDUSTRIAL APPLICABILITY

The present invention can be preferably used as applicators such as those for liquid eyeliner and liquid eye shadow.

DESCRIPTION OF REFERENCE NUMERALS

10 extrusion device (liquid thrusting mechanism)
12 barrel body
13 advancing member
17 piston body

18 sealing part
19 joint member
20 front barrel
21 flow passage
30 applicator part (the first embodiment)
30A applicator part (the second embodiment)
31 conical part (the first embodiment)
31A conical part (the second embodiment)
32*a* thin disk
33 groove
34 liquid flow passage
35 slit (the first embodiment)
35A slit (the second embodiment)
70 fiber hairs

The invention claimed is:

1. An applicator comprising:
an applicator part configured to discharge or apply a content liquid;
a reservoir charged with the content liquid; and
an extrusion device configured to extrude the content liquid to the applicator part,
wherein
a flow passage that connects between the applicator part and the reservoir is provided,
by extruding the content liquid inside the reservoir by means of the extrusion device, the content liquid is discharged from the applicator part as passing through the flow passage communicating between the applicator part and the reservoir,
the applicator part has a conical part formed in an approximate conical shape,
the conical part has a plurality of thin disks arranged concentrically,
outside diameters of the thin disks define the conical shape from a front end to a rear,
a plurality of grooves are formed through the thin disks in a front-to-rear direction of the applicator part,
a liquid flow passage connected to the flow path, is provided inside the conical part, the liquid flow passage being formed in an approximate conical shape,
slits each connecting between the liquid flow passage and each groove, are provided on the conical part, and
a length of each slit is approximately equal to a length of each groove.

2. An applicator comprising:
an applicator part configured to discharge or apply a content liquid;
a reservoir charged with the content liquid; and
an extrusion device configured to extrude the content liquid to the applicator part,
wherein
a flow passage that connects between the applicator part and the reservoir is provided,
by extruding the content liquid inside the reservoir by means of the extrusion device, the content liquid is discharged from the applicator part as passing through the flow passage communicating between the applicator part and the reservoir,
the applicator part has a conical part formed in an approximate conical shape,
a liquid flow passage connected to the flow path is provided inside the conical part, the liquid flow passage being formed in an approximate conical shape,
a slit connecting the liquid flow passage is formed on the conical part, and
the applicator part has a flange part on a rear end portion of the applicator part, the flange part being used for fixing the applicator part in the applicator.

3. The applicator according to claim 1, wherein an electrostatic flocking process is performed on a surface of the applicator part.

4. The applicator according to claim 1, wherein the applicator part comprises rubber or elastomer.

5. The applicator according to claim 1, wherein the plurality of grooves are 0.1 to 1 mm wide and 0.05 to 2 mm deep.

6. The applicator according to claim 1, wherein an electrostatic flocking process is performed on a surface of the applicator, and the electrostatic flocking process adheres fibers having a fiber diameter of 0.05 to 0.7 mm and a fiber length of 0.05 to 1 mm.

7. The applicator according to claim 1, wherein, when the applicator part is fitted to a front barrel, the slit of the applicator part is formed in a position outside the front barrel.

8. The applicator according to claim 1, wherein an opening area for each slit is 0.5 to 2.0 $mm^2$.

9. The applicator according to claim 2, wherein an electrostatic flocking process is performed on a surface of the applicator part.

10. The applicator according to claim 2, wherein the applicator part comprises rubber or elastomer.

11. The applicator according to claim 2, wherein an electrostatic flocking process is performed on a surface of the applicator, and the electrostatic flocking process adheres fibers having a fiber diameter of 0.05 to 0.7 mm and a fiber length of 0.05 to 1 mm.

12. The applicator according to claim 2, wherein, when the applicator part is fitted to a front barrel, the slit of the applicator part is formed in a position outside the front barrel.

13. The applicator according to claim 2, wherein an opening area for each slit is 0.5 to 2.0 $mm^2$.

* * * * *